US010898037B2

(12) United States Patent
Fomine

(10) Patent No.: US 10,898,037 B2
(45) Date of Patent: Jan. 26, 2021

(54) DISPENSER AND CLEANING ASSEMBLY

(71) Applicant: Alexei Fomine, Houston, TX (US)

(72) Inventor: Alexei Fomine, Houston, TX (US)

( * ) Notice: Subject to any disclaimer, the term of this patent is extended or adjusted under 35 U.S.C. 154(b) by 43 days.

(21) Appl. No.: 16/294,784

(22) Filed: Mar. 6, 2019

(65) Prior Publication Data

US 2020/0281422 A1 Sep. 10, 2020

(51) Int. Cl.

| | |
|---|---|
| ***A47K 10/38*** | (2006.01) |
| ***A47L 13/16*** | (2006.01) |
| ***A47K 11/10*** | (2006.01) |
| ***A47K 10/32*** | (2006.01) |

(52) U.S. Cl.

CPC ..... *A47K 10/3818* (2013.01); *A47K 11/105* (2013.01); *A47L 13/16* (2013.01); *A47K 10/3845* (2013.01); *A47K 2010/3233* (2013.01); *A47K 2010/3266* (2013.01); *A47K 2010/389* (2013.01)

(58) Field of Classification Search

CPC ..... A47K 10/32; A47K 10/34; A47K 10/36; A47K 10/38; A47K 10/3206; A47K 10/3233; A47K 10/3662; A47K 10/3818; A47K 10/3827; A47K 2010/3266; A47K 2010/3273; A47K 2010/3681; A47K 2010/3845; A47K 11/105; A47L 13/16

See application file for complete search history.

(56) References Cited

U.S. PATENT DOCUMENTS

| | | | | |
|---|---|---|---|---|
| 4,984,530 A * | 1/1991 | Dutton | A47K 10/28 | 118/235 |
| 5,323,507 A * | 6/1994 | Tosato | A47L 13/46 | 15/231 |
| 5,439,521 A * | 8/1995 | Rao | A47K 10/3827 | 118/415 |
| 7,185,841 B2 * | 3/2007 | Kaufmann | A47K 10/32 | 242/564.4 |
| 2009/0314875 A1 * | 12/2009 | Granger | A47K 10/3643 | 242/560 |
| 2014/0076916 A1 * | 3/2014 | Boyce | A47K 10/3827 | 221/34 |
| 2015/0059113 A1 * | 3/2015 | Zorzo | A47L 13/16 | 15/231 |

* cited by examiner

*Primary Examiner* — Sang K Kim
*Assistant Examiner* — Nathaniel L Adams
(74) *Attorney, Agent, or Firm* — Law Office of Jeff Williams PLLC; J. Oliver Williams

(57) ABSTRACT

A cleaning assembly includes a handle assembly configured to grasp a moistened tissue. A drum is included within a dispensing unit to store the tissue. The dispensing unit selectively releases the tissue from the drum as an actuating assembly operates a lever between a first position and a second position. The drum is seated within the dispensing unit in communication with the actuating assembly in a manner such that the tissues are sealed and prevented from drying out. The seal is selectively broken to permit dispensing of the tissues. The cleaning assembly permits a user the ability to clean a potentially unclean surface without the need to physically contact any of the cleaning tissue, chemicals, or surface itself at any time. The user is separated from the potentially harmful surfaces and chemicals.

16 Claims, 9 Drawing Sheets

DISPENSER AND CLEANING ASSEMBLY

BACKGROUND

1. Field of the Invention

The present application relates generally to handheld cleaning devices, and more particularly to an assembly for dispensing moistened towelettes and a handle device for grasping and using the towelettes.

2. Description of Related Art

A concern for a large number of individuals is cleanliness of surfaces in homes and businesses that are frequented. Direct hand contact with unsanitary or unclean surfaces as well as cleaning chemicals used to clean the surfaces is undesirable. In one instance, a common area of concern is the bathroom, and in particular the toilet seat. Many methods and devices have been developed to ensure the proper cleanliness of the toilet. For example, a cleaning compound and fluids may be sprayed onto a surface from a spray bottle to clean or sanitize the surface. Upon application to the surface, a user often wipes the dirty surface with a rag, sponge, tissue, or other similar cleaning device. In this instance, the cleaning device requires user's hand to be in close proximity to the surface, often in direct contact with the cleaning surface and/or the cleaning tissue. The tissue then becomes quickly saturated, typically contacting with the user's hand, after which the device or tissue must be discarded, cleaned, or laundered. Although, some devices do protect the user from holding the cleaning tissue directly by hand during the cleaning, after the cleaning it still requires the user to grab the tissue by hand to discard it. After such use, a user may be required to wash his/her hands, which is inconvenient and inefficient.

It is understood that this method of cleaning a surface has multiple limitations and disadvantages. For instance, to perform the cleaning, the user's hand is in direct contact with the cleaning tissue prior to cleaning, during, or after it once the cleaning tissue needs to be discarded or cleaned. Hands are susceptible to contacting the dirty surface and the saturated areas of the cleaning tissue itself causing many users psychological distress and possible irritation.

As a result, some users aim to avoid such close contact with cleaning devices or surfaces, especially toilet seats, while many others completely avoid use of any publicly accessible toilets due to unsanitary conditions, as well as unavailability of effective cleaning devices. Additionally, many individuals have allergies or other harmful reactions and irritations from various cleaning products that may make contact with the cleaning compound hazardous. Others don't want to touch the cleaning tissue because of the odor emitted by the cleaning compound (i.e. alcohol smell). Furthermore, it can be difficult to estimate the amount of cleaning compound and cleaning device necessary to avoid contact with the cleaning compound yet assure a thorough cleaning.

These disadvantages are only amplified by the thought of unsanitary surfaces in commercial establishments: public toilets, handles, tables, hospitals and so forth. For example, in hospitals there may exist any number of viruses and bacteria, or even biological substances that need to be cleaned up from a surface (i.e. blood). It is undesirable for a user to come into contact with any of these. Cleaning becomes even more complicated since many cleaning devices are stored apart from the cleaning tissue, forcing user to travel to the tissue storage container each time a tissue refill is needed, increasing chances of contamination and contact with tissues, dirt, and cleaning chemicals.

Although strides have been made to provide better cleaning devices and techniques, shortcomings remain. An improved cleaning device that separates the user from direct contact with the surface, cleaning compound, and cleaning tissue while providing a ready supply of saturated cleaning tissue for further use is needed.

SUMMARY OF THE INVENTION

It is an object of the present application to provide a cleaning assembly that includes a handle assembly configured to grasp a moistened tissue. A drum is included within a dispensing unit and configured to store the tissue. The dispensing unit selectively releases the tissue from the drum as an actuating assembly operates a lever between a first position and a second position. The drum is seated within the dispensing unit in communication with the actuating assembly. The cleaning assembly is designed to permit a user the ability to dispense a moistened tissue, grasp a moistened tissue, and clean with a moistened tissue without any contact with the moistened tissue or the selected cleaning surface.

It is a further object that the cleaning assembly engage with the drum in a manner that prevents the drying out of the moistened tissue. The cleaning assembly has a housing with a platform that seals around an opening of the drum. Also included is a moving platform that selectively seals beneath the housing platform. The moving platform disengages from the housing platform upon releasing of the moistened tissue.

Another object of the present application is to provide an actuating assembly that operates to disengage the moving platform from the housing platform prior to initiation of the rollers beginning the withdrawal of the moistened tissue. This prevents the moistened tissue from tearing. Movement of the lever arm in the actuating assembly first lowers the moving platform and then subsequently initiates the rollers as it moves from a first position to a second position.

The drum is configured to be interchangeable and optionally refillable with tissue.

The handle includes a jaw that opens and closes via an input from a user. The jaw is designed to grasp the moistened tissue when dispensed from the dispensing unit. With the handle, the user is able to locate the tissue on a desired surface and scrub the surface by pressing a pad of the handle against the tissue on the surface. The hands of the user never have to contact the tissue at any time.

Another object of the present application is to provide a tissue dispensing unit for a wall that contains tissue. The unit includes a drum configured to store the tissue. The drum has an opening for passage of the tissue outside of the drum. The assembly further includes a housing configured to store the drum on a housing platform, the housing platform has a slot for the passage of the tissue external to the drum and includes a seal around the slot. The seal is configured to seal about the opening of the drum. Additionally, the unit includes an actuating assembly with a lever for initiating the dispensing of the tissue external to the housing.

The unit includes a moving platform configured to selectively seal against the housing platform and the slot. The lever initiates movement of the moving platform. Likewise, the actuating assembly includes a plurality of rollers configured to apply a force to the tissue so as to dispense it from the drum and externally to the housing. The plurality of rollers operating only after the moving platform disengages from the housing platform and slot.

The tissue dispensing unit may be mounted away from a wall such as on a stand to allow it freedom to sit in any location, or be set on a counter or elevated surface.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
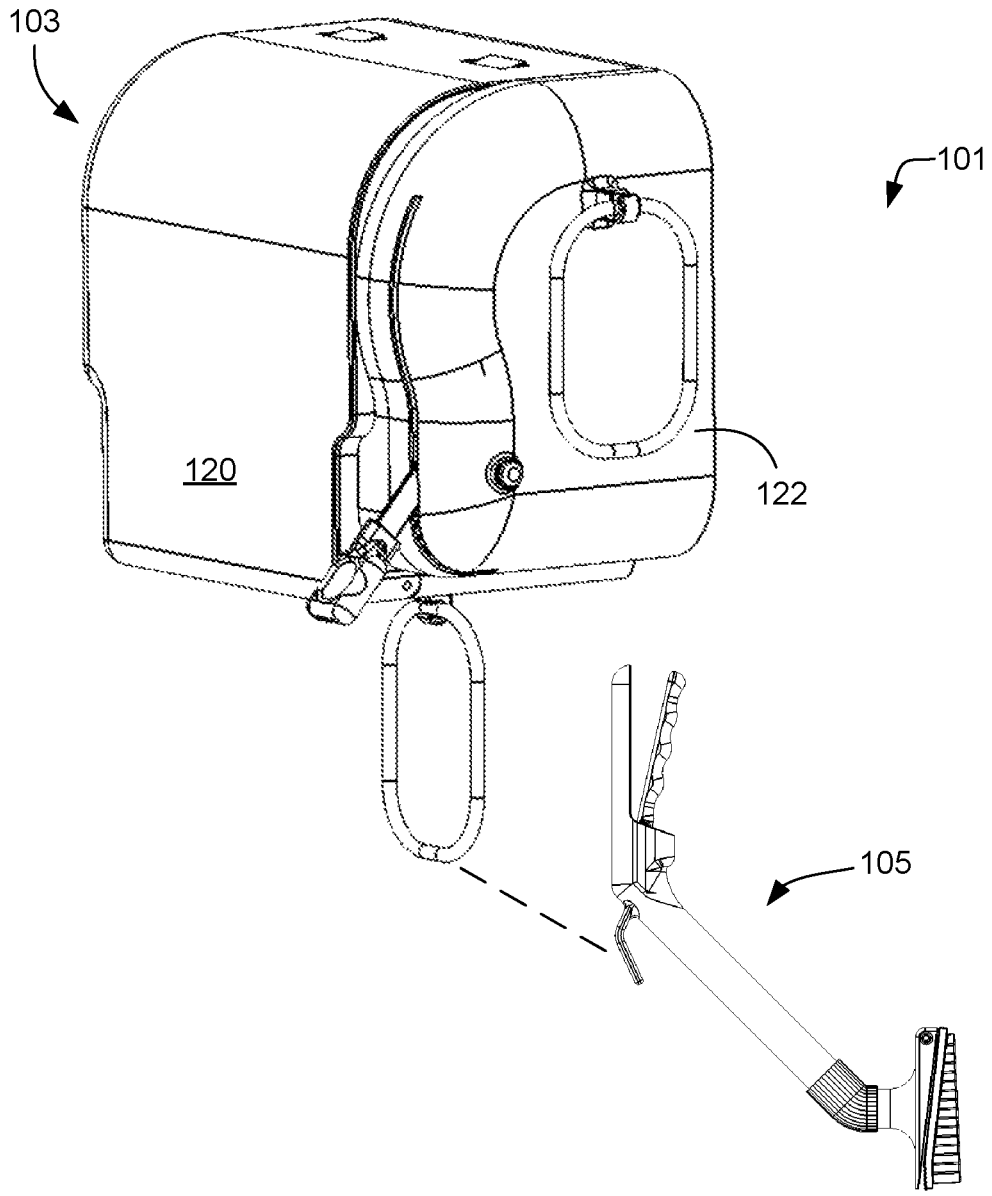
FIG. 1 is a perspective view of a cleaning assembly according to an embodiment of the present application.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The embodiments and method in accordance with the present application overcomes one or more of the above-discussed problems commonly associated with elevated platforms discussed previously. In particular, the cleaning assembly of the present application permits a user the ability to clean a potentially unclean surface without the need to physically contact any of the cleaning tissue, chemicals, or surface itself at any time. The user is separated from the potentially harmful surfaces and chemicals. These and other unique features are discussed below and illustrated in the accompanying drawings.

The embodiments and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The embodiments and method of the present application is illustrated in the associated drawings. The cleaning assembly includes a handle assembly configured to grasp a moistened tissue. A drum is included within a dispensing unit to store the tissue. The dispensing unit selectively releases the tissue from the drum as an actuating assembly operates a lever between a first position and a second position. The drum is seated within the dispensing unit in communication with the actuating assembly in a manner such that the tissues are sealed and prevented from drying out. Additional features and functions are illustrated and discussed below.

Referring now to the Figures wherein like reference characters identify corresponding or similar elements in form and function throughout the several views. The following Figures describe embodiments of the present application and its associated features. With reference now to the Figures, embodiments of the present application are herein described. It should be noted that the articles "a", "an", and "the", as used in this specification, include plural referents unless the content clearly dictates otherwise.

Referring now to FIG. 1 in the drawings, a perspective view of a cleaning assembly is illustrated. Cleaning assembly 101 includes a dispensing unit 103 and a handle assembly 105. Within the dispensing unit 103 is a plurality of tissues (not shown) that are selectively dispensed externally from the dispensing unit 103. Handle assembly 105 is configured to be obtained by a user and grasp the dispensed tissue and provide a means of exerting a force upon the tissue on a surface to be cleaned. The user is separated from the tissue, the cleaning surface, and any chemicals on the tissue at all times. The tissue may be discarded by operating the handle. As seen in FIG. 1, the handle assembly 105 includes a hook which permits it to rest on and/or hang from a portion of dispensing unit 103.

Figure 2:
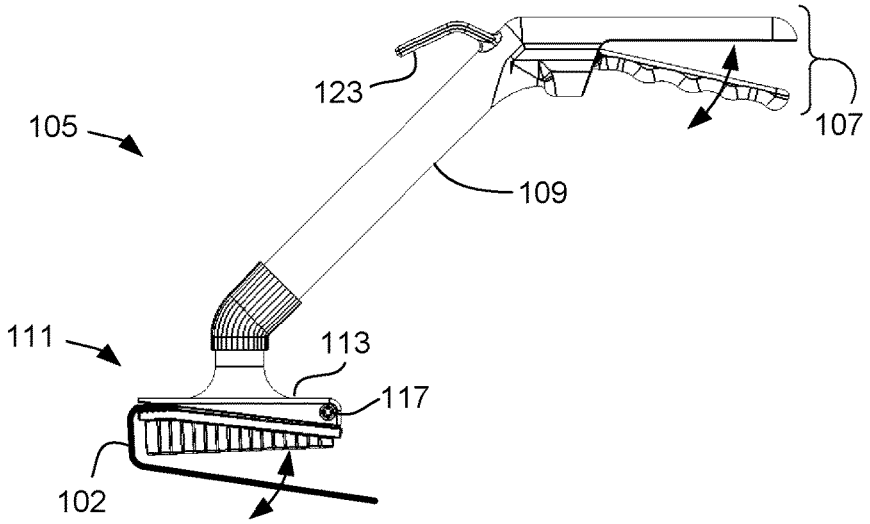
FIG. 2 is a side view of a handle assembly used in the cleaning assembly of FIG. 1.
Figure 3:
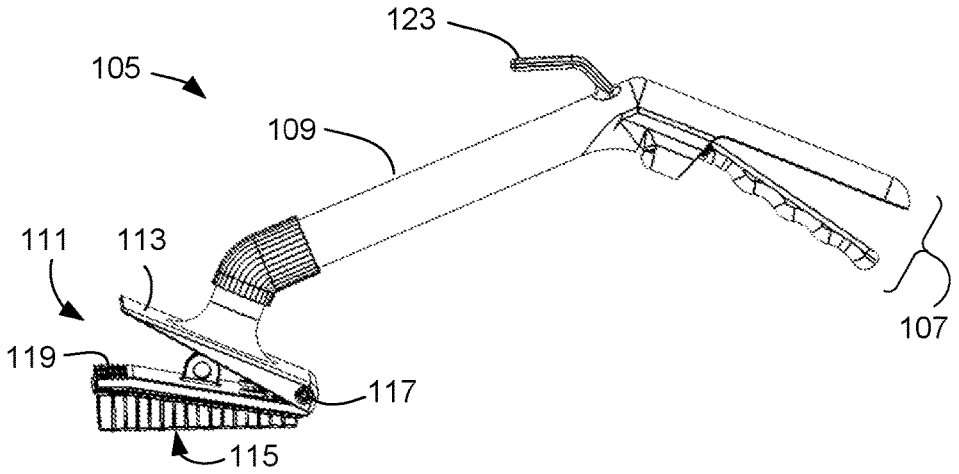
FIG. 3 is an alternate side view of the handle assembly of FIG. 2, with a clamp in an open position.
Figure 4:
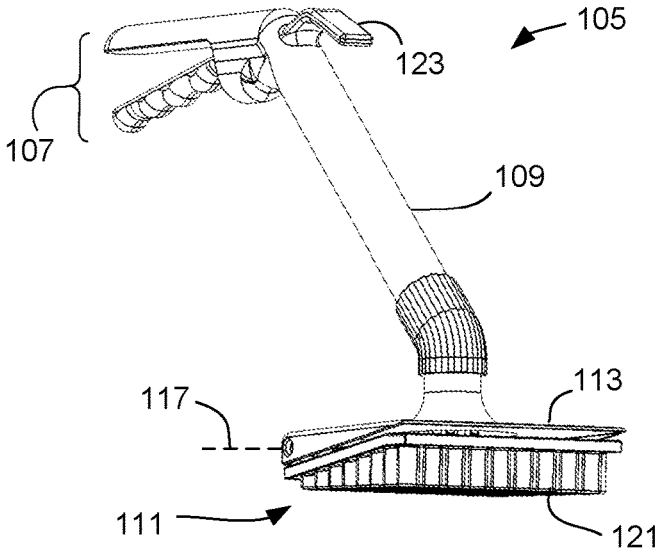
FIG. 4 is a front perspective view of the handle assembly of FIG. 2.

Referring now also to FIGS. 2-4 in the drawings, assorted views of handle assembly 105 are illustrated. Handle assembly 105 includes a handle 107, a shaft 109, and a clamp 111. Shaft 109 extends between handle 107 and clamp 111 and is useful to maintain separation of the user from the clamp 111. With handle 107, a user is able to grasp onto handle assembly 105 and operate clamp 111. Clamp 111 is configured to operate between an open and a closed position. In FIGS. 2 and 4, clamp 111 is closed. In FIG. 3, clamp 111 is shown in an open position.

At the base of shaft 109, clamp 111 includes a base 113 and a lower member 115. When handle 107 is actuated, lower member 115 pivots relative to base 113 along axis 117 so as to partially separate from one another. Along an upper surface of lower member 115 is a textured surface 119 to assist in grasping and holding the tissue 102. Once the tissue 102 is inserted into the open clamp 111, a user may release handle 107 and close clamp 111. The tissue is then laid onto a surface and a pad 121 along a lower surface of lower member 115 is pressed against the tissue 102 on the surface to be cleaned. As seen in the Figures, the hook 123 is located on shaft 109. It is understood that hook 123 may be located at any location on handle assembly 105 that adequately provides the capability of coupling with a portion of dispensing unit 103

Figure 5:
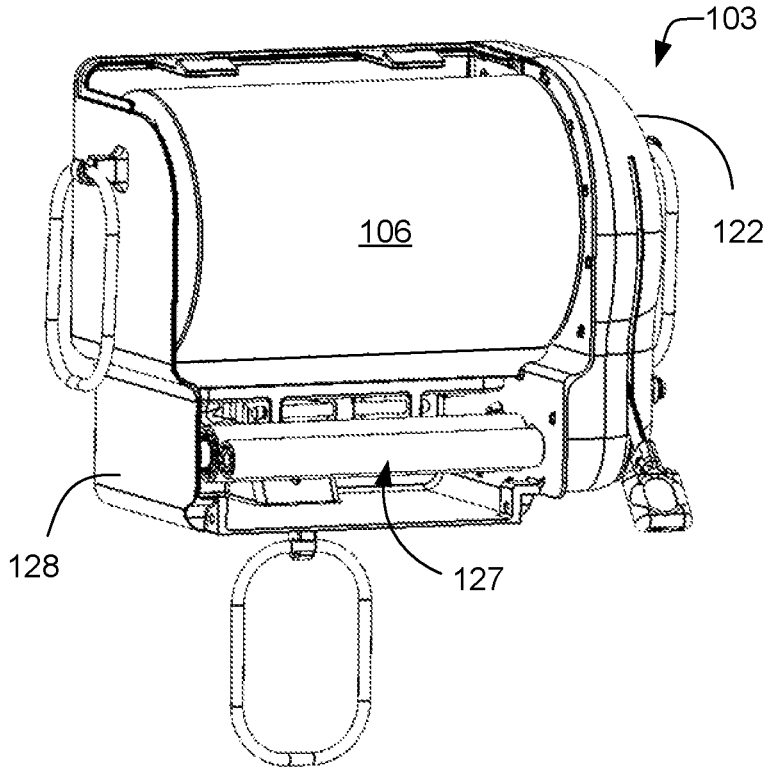
FIG. 5 is a front perspective view of a dispensing unit used in the cleaning assembly of FIG. 1 with a front cover removed.
Figure 6:
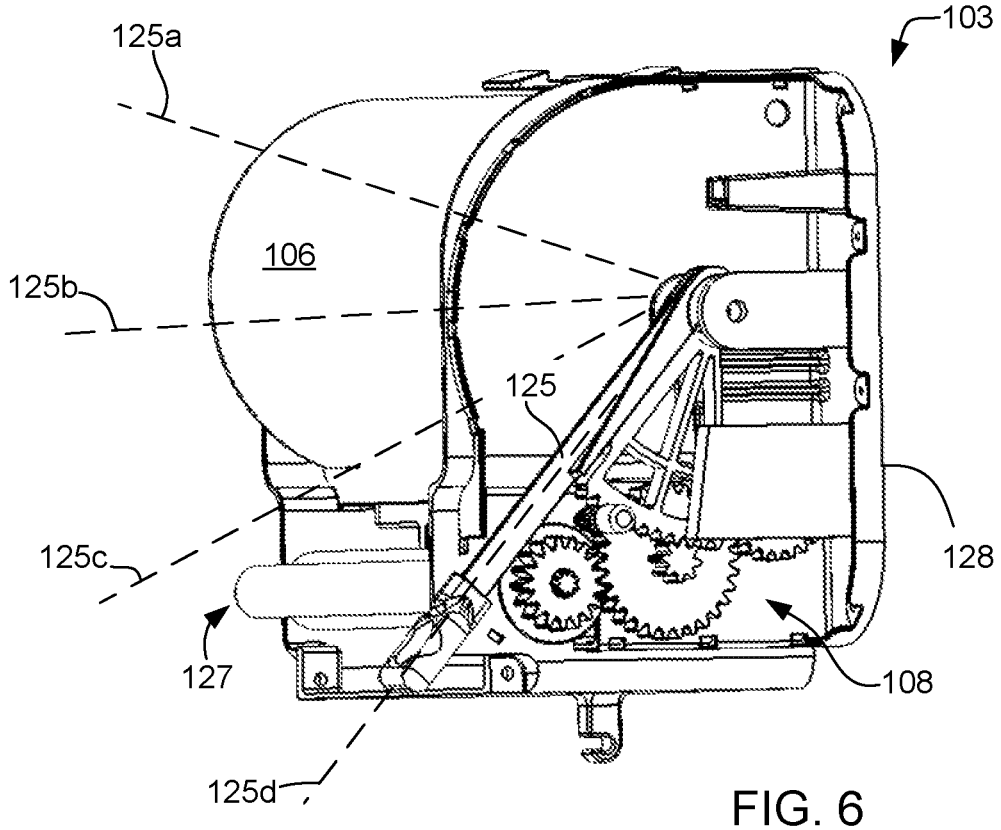
FIG. 6 is a side perspective view of the dispensing unit of FIG. 5 with a side cover removed.

Referring now also to FIGS. 5 and 6 in the drawings, a front perspective view of dispensing unit 103 is shown with a front cover removed for clarity, along with a side perspective view with a side cover removed. Front cover 120 is removed in FIG. 5 to show the internal workings of unit 103. A drum 106 is seated internally therein. Within drum 106 is a plurality of tissues 102. The tissues are preferably moistened with a chemical of some type to assist in sanitizing and cleaning. However, the tissues may be dry.

As seen in FIG. 6, unit 103 includes an actuating assembly 108 configured to facilitate the dispensing of tissues from drum 106. A plurality of gears, shafts, linkages, and other components are included within actuating assembly 108, and are coupled to a housing 128. Each is used to help ensure proper operational timing of unit 103 such that the tissues are sealed/unsealed and/or dispensed in a proper sequence. In FIG. 6, side cover 122 is removed actuating assembly 108.

Assembly 108 includes a lever 125 operable between a plurality of positions. The positions are designated as positions 125*a*-125*d*. Position 125*a* is a neutral position used prior to initiating any dispensing action of tissues 102. From position 125*a* to position 125*b*, the drum and tissues are unsealed. From position 125*b* to position 125*c*, the rollers 127 of assembly 108 are activated and apply a force to the tissue 102 so as to dispense it from the drum 106 externally to unit 103. The rollers 127 rotate as lever 125 is in motion between positions 125*b* to 125*c* only. Further discussion related to the operation of assembly 108 with handle 124 will be provided later with FIGS. 10 and 11.

It is understood that although a lever is disclosed, it is only meant to be a single example of a manually operated unit 103. In other embodiments, unit 103 may utilize an electronic actuating assembly 108 having a motor and a motion sensor that can automatically sense motion and then dispense a predetermined amount of tissue. Additionally, a combination of the two types may be combined into a single embodiment with a button used to select between the two types. For purposes here, a manual operation will be discussed.

Figure 7:
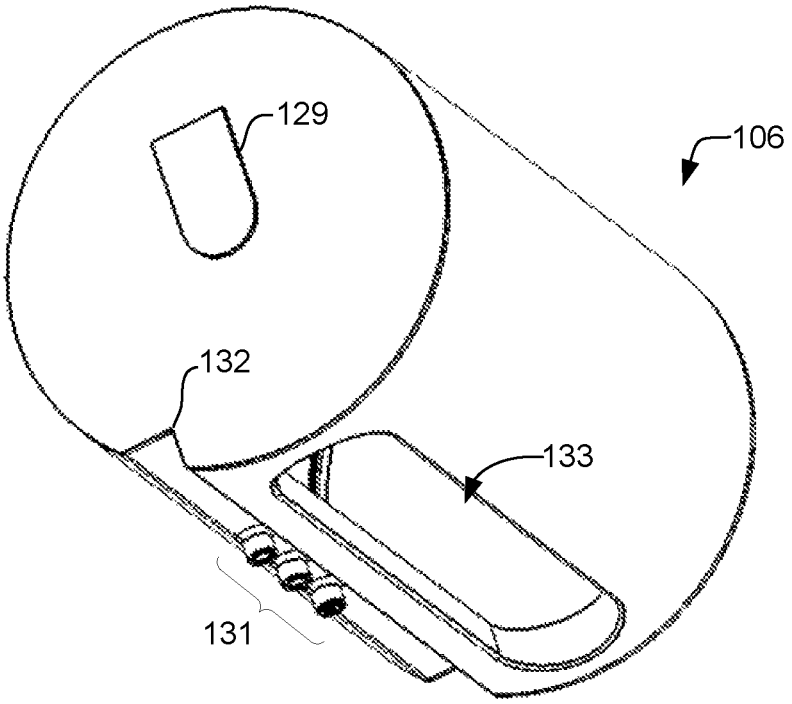
FIG. 7 is a front lower perspective view of a drum in the cleaning assembly of FIG. 1.
Figure 8:
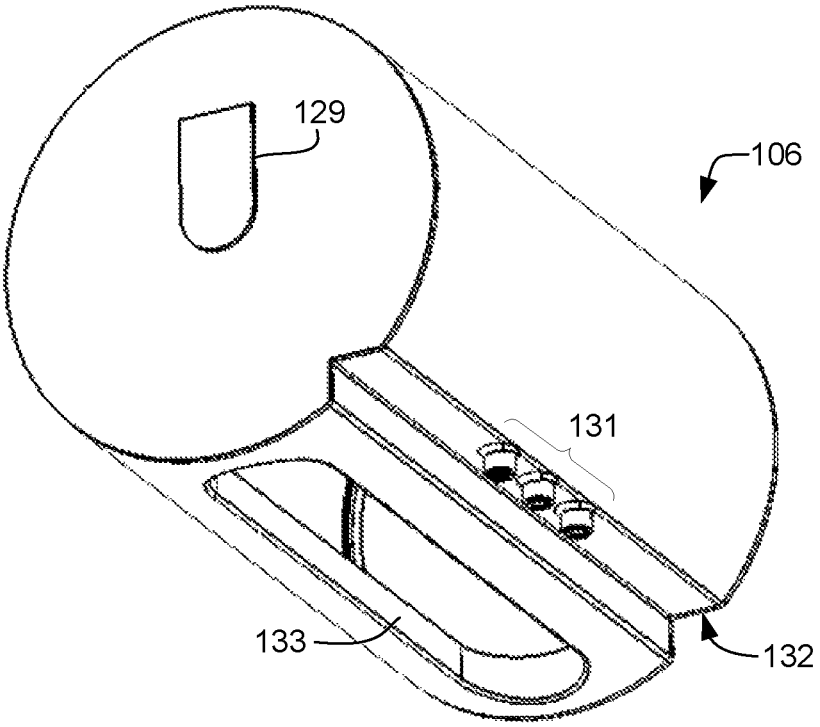
FIG. 8 is a rear lower perspective view of the drum of FIG. 7.

Referring now also to FIGS. 7 and 8 in the drawings, views of drum 106 are provided. Drum 106 is a cylindrical body having opposing ends that are capped off. Each end has a detent 129 extending outward to assist in proper alignment of drum 106 when seating within housing 128. A notched portion 132 exists on the lower area of drum 10. In the notched portion 132 is a keyed portion 131 having a series of protrusions extending from a surface thereof. The keyed portion 131 is unique to the type of drum 106 and is useful in restricting use of unit 103 to authorized or legitimate drums 106 from the original manufacturer. Drum 106 is interchangeable from housing 128. For example, when tissues 102 run out, drum 106 may be interchanged with a separate drum. It is understood that the keyed portion 131 may have any number of different protrusions. In one embodiment it is conceived that keyed portion 131 may consist of any type of device such as an electronic device that may emit a signal for authentication. Any manual, physical, and/or electronic keyed portion 131 is conceivable.

Additionally, drum 106 includes an opening 133. Opening 133 is aligned with detents 129 to permit function within housing 128. Tissues 102 pass from an internal location within drum 106 through opening 133.

Figure 9:
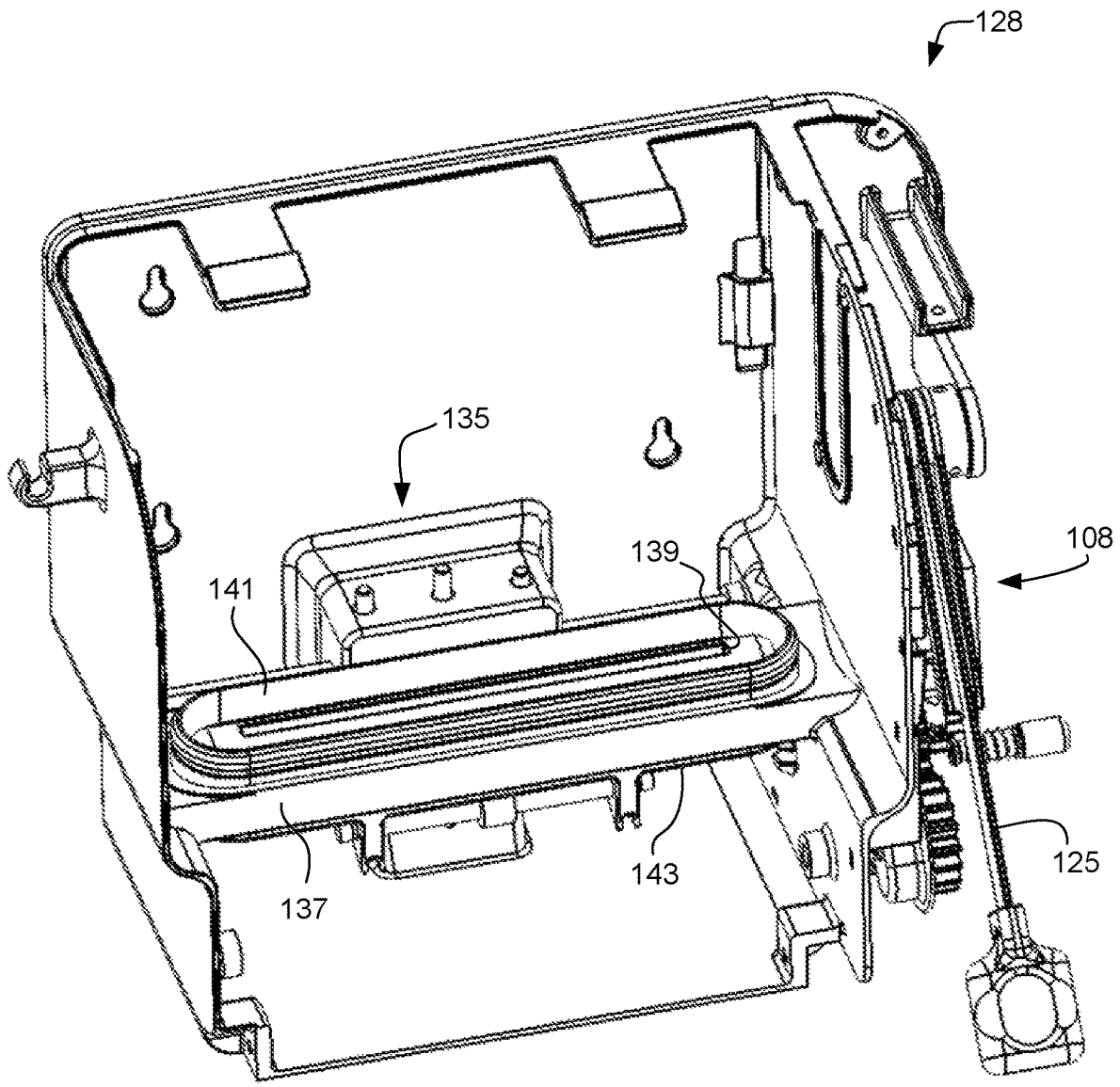
FIG. 9 is a front perspective view of a housing of the dispensing unit of FIG. 5.

Referring now also to FIG. 9 in the drawings, a front perspective view of housing 128 is illustrated. In this Figure, drum 106 is removed for clarity. Of note is the mating portion 135 located internally. This is to match up with keyed portion 131. When the mating portion 135 and keyed portion 131 match, operation of actuating assembly 108 is permitted. In other words, operation of actuating assembly 108 is regulated by keyed portion 131 and mating portion 135 being a match or not.

Another feature of housing 128 is the use of a housing platform 137 extending from side to side of the internal cavity. Platform 137 includes a slot 139. Drum 106 is configured to align with platform 137 and slot 139 in particular. As tissues 102 leave drum 106, they are to pass through slot 139. Platform 137 also includes a seal 141 that rests on an upper surface of platform 137 and extends around slot 139. As drum 106 is located or seated within housing 128, opening 133 is seated within seal 141 above slot 139. Seal 141 is between platform 137 and drum 106. Seal 141 prevents moisture from leaving drum 106 and the drying out of tissues 102.

As noted previously, tissues 102 pass through slot 139, therefore a means of sealing slot 139 from the bottom of platform 137 is necessary. Actuating assembly 108 further includes a moving platform 143 in communication with lever 125 through one or more gears. As lever 125 actuates through positions, moving platform 143 is configured to move (i.e. pivot, rotate, translate, etc.). Moving platform 143 is configured to seat against a lower surface of platform 137 and seal around slot 139. This effectively seals out any air and moisture loss within drum 106.

Figure 10:
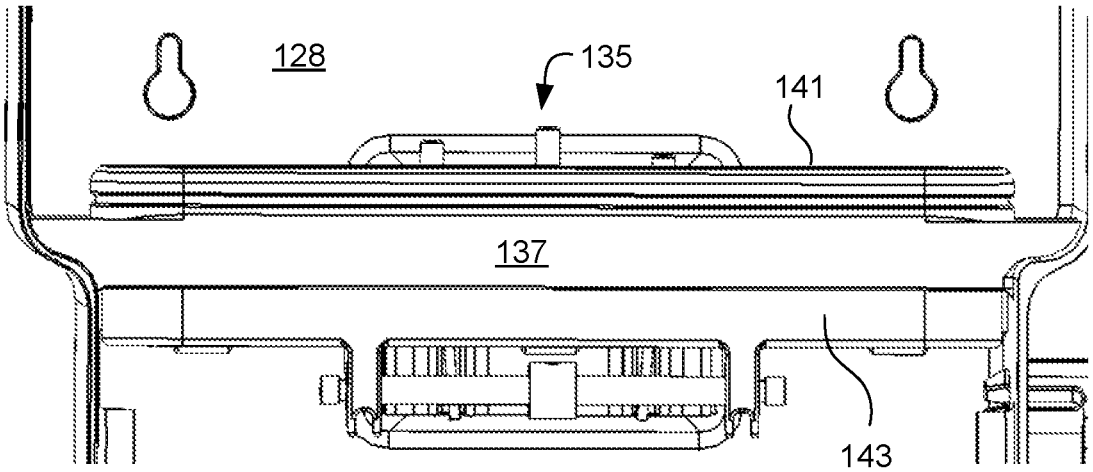
FIGS. 10 and 11 are enlarged front views of the housing of FIG. 9.
Figure 11:
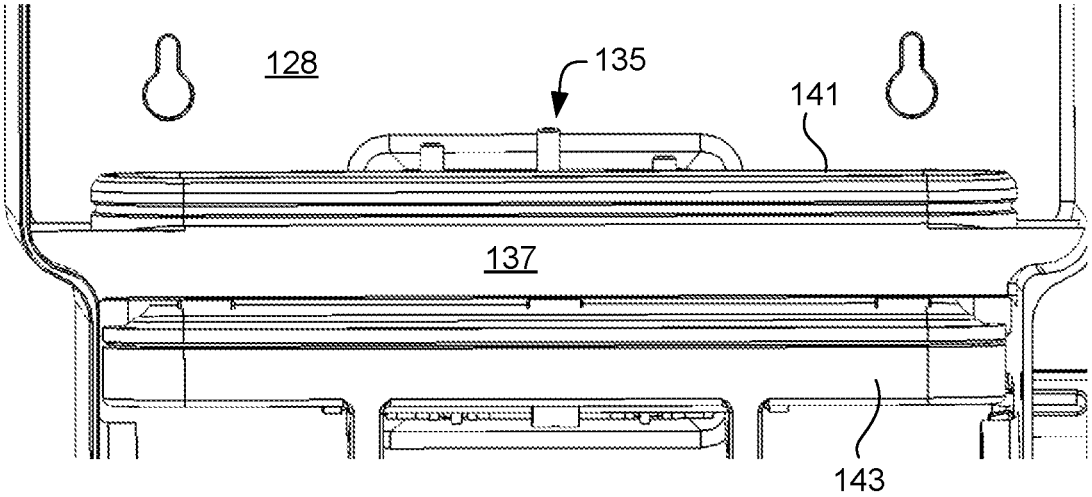

Referring now also to FIGS. 10 and 11 in the drawings, enlarged front views of platform 137 and moving platform 143 are illustrated in different positions. In FIG. 10, moving platform 143 is located in a seated position against the lower surface of platform 137, thereby sealing out air from drum 106. In this position, lever 125 is in position 125*a*. In FIG. 11, moving platform 143 is shown in a lowered position. This occurs as lever 125 is moved to position 125*b*. Moving platform then stays in a lowered position until lever 125 is moved back to position 125*a*. Moving platform 143 remains lowered through positions 125*b*-125*d*. It is understood that the amount of movement of platform 143 can vary. Movement is necessary to release tissues 102 to allow rollers 127 to pull or dispense more tissue for a user. In position 125*d*, rollers 127 are not rotated and moving platform 143 is maintained in a lowered position. In this condition, drum 106 is more easily interchanged as slot 139 is open through platform 137. A new drum 106 may be inserted and tissue 102 passed through slot 139 prior to making its way through rollers 127. Once reloaded or in a ready to operate condition, lever 125 may then be rotated back up to position 125*a* ready for dispensing. Rollers 127 are not necessarily configured to rotate when lever 125 goes from positions 125*d* or 125*c* to 125*a*. rotation of rollers 127 would cause either more tissue 10 be dispensed or some tissue to be retracted. This is unnecessary although possible in selected configurations.

Figure 12:
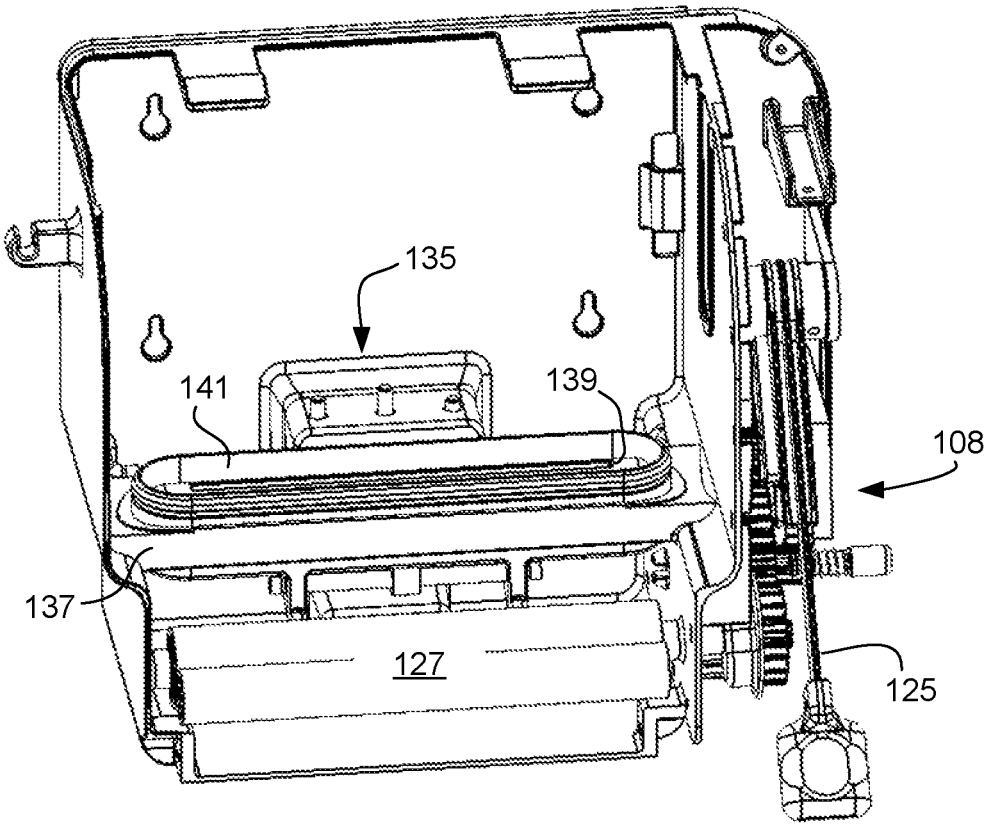
FIG. 12 is a front perspective view of the dispensing unit of FIG. 5, with a drum and side cover removed.
Figure 13:
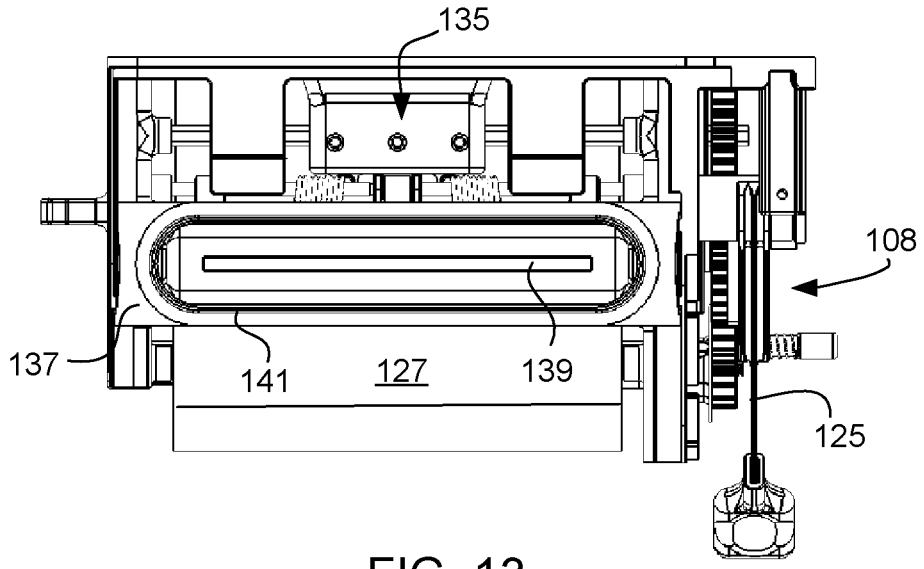
FIG. 13 is a top view of the dispensing unit of FIG. 12.
Figure 14:
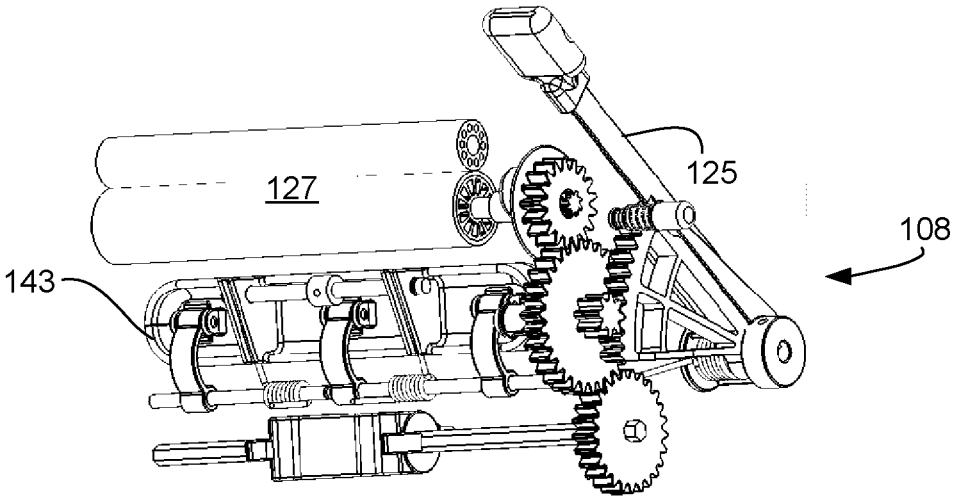
FIG. 14 is a lower perspective view of an actuating assembly in the dispensing unit of FIG. 12.

Referring now also to FIGS. 12 and 13 in the drawings, views of housing 128 with actuator assembly 108 and rollers 127 are provided.

Figure 15:
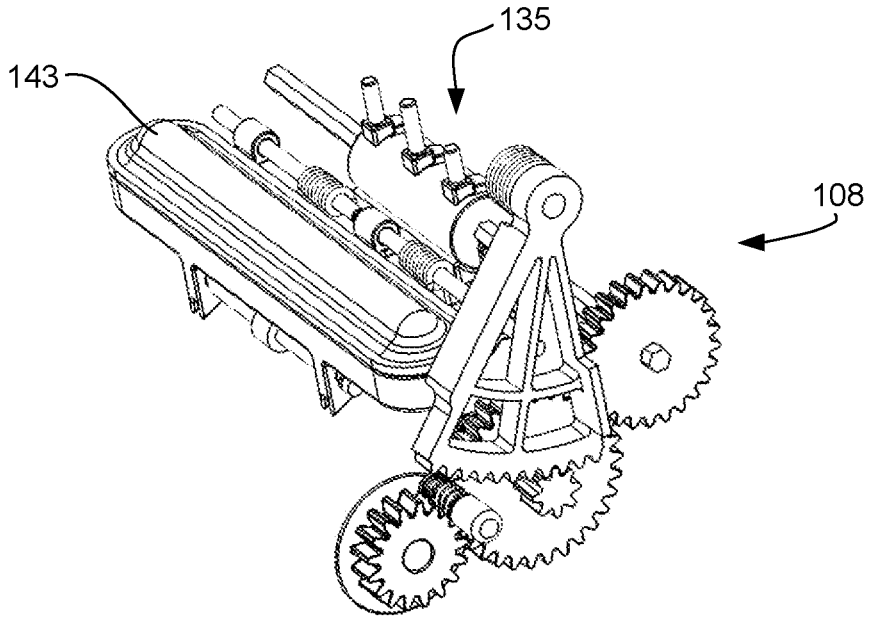
FIG. 15 is an upper perspective view of the actuating assembly of FIG. 14.
Figure 16:
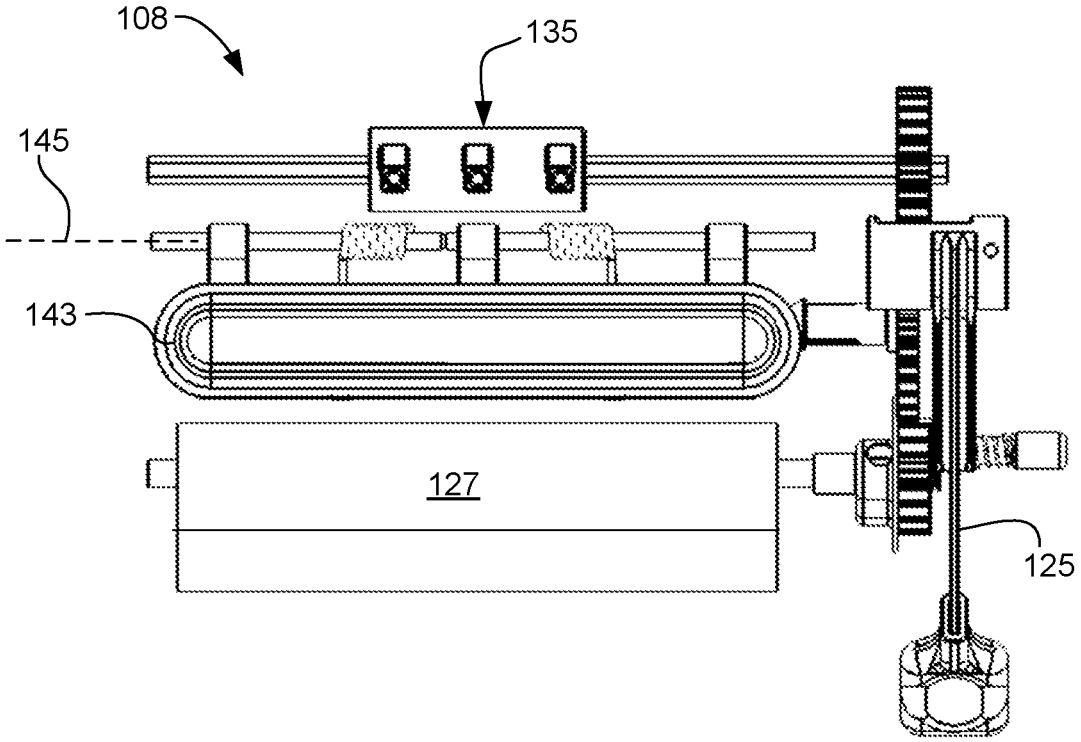
FIG. 16 is a top view of the actuating assembly of FIG. 14.
Figure 17:
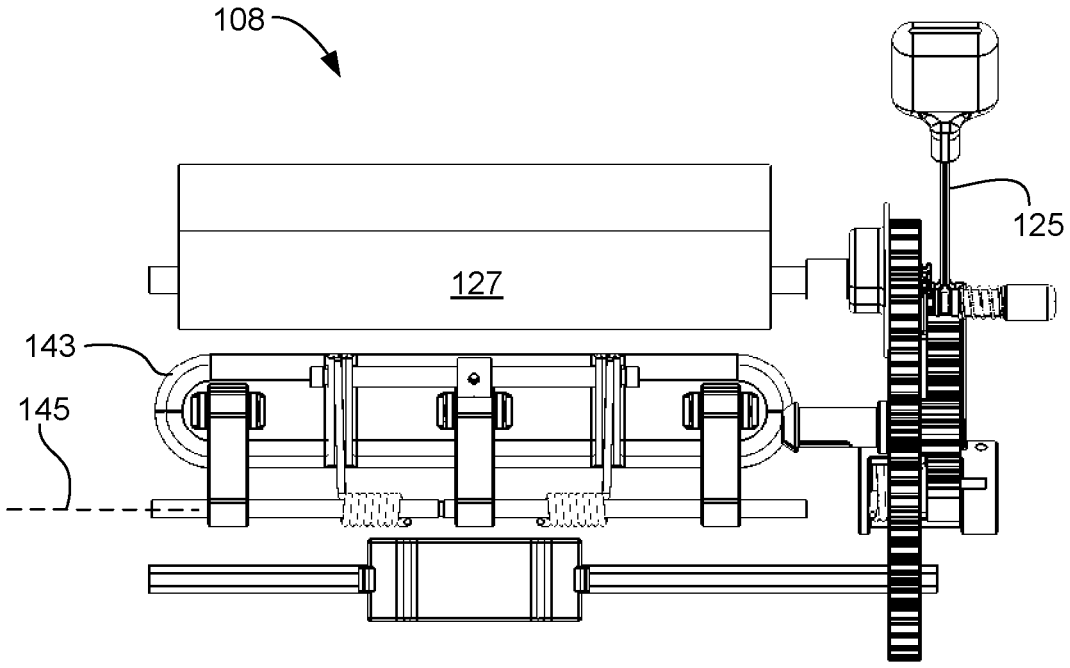
FIG. 17 is a lower view of the actuating assembly of FIG. 14.

Referring now also to FIGS. 14-17 in the drawings, views of actuator assembly 108 are provided. As noted previously, actuator assembly 108 includes lever 125, a plurality of gears or mechanical actuation devices, moving platform 143, and rollers 127. As lever 125 changes positions, the gears sequentially operate the moving platform 143 followed by the rollers 127. Keyed portion 131 and mating portion 135 act as a security locking device to regulate movement of lever 125 and the operation of unit 103. As seen in FIG. 15 in particular, moving platform 143 is shaped so as to seat with and match the contour of platform 137. It is understood that other shapes are possible.

Lever 125 is ideally preloaded with a set resting position in the upper position of position 125*a*. This means transitioning into positions 125*b* and 125*c* will have some feedback moment on the user as lever 125 naturally wants to rest in position 125*a*. However, in position 125*d*, the feedback moment of lever 125 is done away to allow for interchanging. In the preferred embodiment, lever 125 naturally stays in position 125*d* when placed there and until a user changes its position. In other embodiment, lever 125 may be held there by a securing device as feedback moment may be felt in all positions. If left alone, lever 125 will transition to position 125*a* from positions 125*b* and 125*c*.

Moving platform 143 is configured to rotate about axis 145. Springs are coupled to the axis rod to ensure a preloaded pressure in the seated position. This pressure is overcome through movement of lever 125 to position 125*b*.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A cleaning assembly, comprising:

a handle assembly configured to grasp a tissue;

a drum configured to store the tissue, the drum includes an opening to dispense the tissue; and a dispensing unit configured to selectively release the tissue, the drum being located within a housing of the dispensing unit, the dispensing unit including an actuating assembly for dispensing the tissue external to the housing;

wherein the opening of the drum is surrounded by a seal on the housing, the tissue passing through a slot in a housing platform used to locate the seal, the slot surrounded by the seal; and wherein the actuating assembly includes a lever operable between a plurality of positions and a moving platform configured to selective seal against the slot, the lever initiating movement of the moving platform.

2. The assembly of claim 1, wherein the dispensing unit is configured to seal the opening of the drum between dispensing of the tissue to maintain the moisture of the tissue.

3. The assembly of claim 2, wherein the actuating assembly includes the lever, the lever operable between the plurality of positions, the actuating assembly dispensing the tissue as the lever changes position.

4. The assembly of claim 1, wherein the housing includes the housing platform, the drum contacting the housing platform.

5. The assembly of claim 4, wherein the housing platform includes the seal, the seal being between the housing platform and the drum.

6. The assembly of claim 5, wherein the drum has the opening, the opening being within and surrounded by the seal.

7. The assembly of claim 6, wherein the actuating assembly includes the moving platform that operably engages with a lower surface of the housing platform, the moving platform sealing against the lower surface to prevent air passing into the drum through the opening.

8. The assembly of claim 1, wherein the actuating assembly includes the moving platform configured to selectively contact the housing platform in the housing, the moving platform separating from the housing platform as the lever arm in the actuating assembly changes between the plurality of positions.

9. The assembly of claim 1, wherein the drum has the opening for passing the tissue therethrough.

10. The assembly of claim 1, wherein the drum is interchangeable from the dispensing unit.

11. The assembly of claim 1, wherein the lever moves the moving platform to break contact with the slot prior to dispensing the tissue through the slot.

12. The assembly of claim 1, wherein the handle assembly includes a handle configured to grasp the tissue.

13. The assembly of claim 1, wherein the handle assembly includes a clamp configured to open and close, the clamp configured to grasp the tissue.

14. The assembly of claim 13, wherein the tissue lays over a pad on a lower surface of the clamp, the pad pressing the tissue against a surface to sanitize the surface.

15. The assembly of claim 13, wherein the tissue is discarded by opening the clamp.

16. A tissue dispensing assembly for a wall, comprising:

a drum configured to store the tissue, the drum having an opening;

a housing configured to store the drum, the drum being located on a housing platform, the housing platform having a slot for the passage of the tissue external to the drum, the housing platform having a seal around the slot, the seal configured to seal about the opening of the drum;

an actuating assembly with a lever for initiating the dispensing of the tissue external to the housing; and a moving platform configured to selectively seal against the housing platform and the slot, the lever initiating movement of the moving platform;

wherein the actuating assembly includes a plurality of rollers configured to apply a force to the tissue so as to dispense it from the drum and externally to the housing, the plurality of rollers operating only after the moving platform disengages from the housing platform and slot.

* * * * *